US009578438B2

(12) United States Patent
Stepputat et al.

(10) Patent No.: US 9,578,438 B2
(45) **Date of Patent: *Feb. 21, 2017**

(54) APPARATUS AND METHOD FOR DRIVING LOUDSPEAKERS OF A SOUND SYSTEM IN A VEHICLE

(71) Applicant: BARCO NV, Kortrijk (BE)

(72) Inventors: Olaf Stepputat, Erfurt (DE); Robert Steffens, Schauenburg (DE)

(73) Assignee: BARCO NV, Kortrijk (BE)

( * ) Notice: Subject to any disclaimer, the term of this patent is extended or adjusted under 35 U.S.C. 154(b) by 142 days.

This patent is subject to a terminal disclaimer.

(21) Appl. No.: 14/389,295

(22) PCT Filed: Mar. 28, 2013

(86) PCT No.: PCT/EP2013/056649

§ 371 (c)(1),
(2) Date: Sep. 29, 2014

(87) PCT Pub. No.: WO2013/144269

PCT Pub. Date: Oct. 3, 2013

(65) Prior Publication Data

US 2015/0055807 A1 Feb. 26, 2015

Related U.S. Application Data

(60) Provisional application No. 61/618,214, filed on Mar. 30, 2012.

(51) Int. Cl.

| | |
|---|---|
| ***H04S 5/02*** | (2006.01) |
| ***H04S 7/00*** | (2006.01) |
| ***H04S 3/00*** | (2006.01) |

(52) U.S. Cl.

CPC ..... *H04S 5/02* (2013.01); *H04S 3/00* (2013.01); *H04S 7/30* (2013.01); *H04S 7/302* (2013.01);

(Continued)

(58) Field of Classification Search

CPC ..... H04S 5/02; H04S 7/30; H04S 3/00; H04S 7/302; H04S 7/303; H04S 2420/13; H04R 2499/13

(Continued)

(56) References Cited

U.S. PATENT DOCUMENTS 7,649,444 B1 * 1/2010 Fear ..... B60Q 5/00 340/384.1
2005/0221877 A1 * 10/2005 Davis ..... H04W 4/02 455/575.9

(Continued)

FOREIGN PATENT DOCUMENTS

EP 2405670 A1 1/2012

OTHER PUBLICATIONS

Michael Strauss et al., "Application of Wave Field Synthesis and Analysis on Automotive Audio", AES 131st Convention, New York, NY, USA, Oct. 20-23, 2011, 4 pages.

(Continued)

*Primary Examiner* — Melur Ramakrishnaiah

(74) *Attorney, Agent, or Firm* — Harness, Dickey & Pierce, PLC

(57) ABSTRACT

An apparatus and a method for driving loudspeakers of a sound system in a vehicle, the system having at least two loudspeakers of a basic system, and a plurality of loudspeakers of a focus system wherein each of the loudspeakers has a position in an environment. The apparatus includes a basic channel provider for providing basic system audio channels for driving the loudspeakers of the basic system and a focused source renderer for providing focus system audio channels to drive the loudspeakers of the focus system. The focused source renderer is configured to calculate a plurality of filter values for the loudspeakers of the focus system (Continued)

based on the positions of the loudspeakers of the focus system and based on a position of a focus point.

20 Claims, 3 Drawing Sheets

(52) U.S. Cl.
CPC ..... *H04R 2499/13* (2013.01); *H04S 7/303* (2013.01); *H04S 2420/13* (2013.01)

(58) Field of Classification Search
USPC .. 381/307, 1, 17, 27, 86, 95, 300, 306, 310; 455/575.9
See application file for complete search history.

(56) References Cited

U.S. PATENT DOCUMENTS

2006/0262935 A1* 11/2006 Goose ..... H04S 3/002 381/17
2007/0189549 A1* 8/2007 Scheel ..... H04R 27/00 381/86
2008/0273725 A1* 11/2008 Hartung ..... H04R 1/403 381/302
2009/0136048 A1* 5/2009 Yoo ..... H04S 3/008 381/27
2009/0154723 A1* 6/2009 Choi ..... H04S 3/002 381/80
2011/0216906 A1* 9/2011 Swaminathan ..... H04R 5/00 381/17
2012/0008806 A1* 1/2012 Hess ..... H04R 1/023 381/302
2013/0261887 A1* 10/2013 Raz ..... B60Q 5/00 701/36

OTHER PUBLICATIONS

Sandra Brix, et al., "Wave Field Synthesis Based Concept Car for High-Quality Automotive Sound", AES Journal, 48th International Conference, Munich, Germany, 10 pages, Sep. 21-23, 2012.
Jens Ahrens et al., "Focusing of Virtual Sound Sources in Higher Order Ambisonics", AES 124th Convention, Amsterdam, The Netherlands, 9 pages, May 17-20, 2008.
International Search Report (ISR) dated Jul. 13, 2012, 3 pages.

* cited by examiner

APPARATUS AND METHOD FOR DRIVING LOUDSPEAKERS OF A SOUND SYSTEM IN A VEHICLE

CROSS-REFERENCE TO RELATED APPLICATION

This application is the U.S. national phase of PCT Application No. PCT/EP2013/056649 filed on Mar. 28, 2013, which claims the benefit of U.S. Provisional Application No. 61/618,214 filed on Mar. 30, 2012, the disclosures of which are incorporated in their entirety by reference herein.

The invention relates to an apparatus and a method for driving loudspeakers of a sound system.

Conventional surround sound systems can produce sounds placed nearly in any direction with respect to a listener positioned in the sweet spot of the system. However, conventional 5.1 or 7.1 surround sound systems do not allow for reproducing auditory events that the listener perceives in a close distance to his head. Several other spatial audio technologies like Wave Field Synthesis (WFS) or Higher Order Ambisonics (HOA) systems are able to produce so called focused sources, which can create that proximity effect using a high number of loudspeakers for concentrating acoustic energy at a determinable position relative to the speakers.

Channel-based surround sound reproduction and object-based scene rendering are known in the art. There exist several surround sound systems that reproduce audio with a plurality of loudspeakers placed around a so called sweet spot. The sweet spot is the place where the listener should be positioned to perceive an optimal spatial impression of the audio content. Most conventional systems of this type are regular 5.1 or 7.1 systems with 5 or 7 loudspeakers positioned on a circle or sphere around the listener and a low frequency effect channel. The audio signals for feeding the loudspeakers are either created during the production process by a mixer (e.g. motion picture sound track) or they are generated in real-time, e.g. in interactive gaming scenarios.

[ACOUSTIC CONTROL BY WAVE FIELD SYNTHESIS, Berkhout, A. de Vries, and Vogel, P. (1993), Journal Acoustic Society of America, 93(5):2764 2778] and [WAVE FIELD SYNTHESIS DEVICE AND METHOD FOR DRIVING AN ARRAY OF LOUDSPEAKERS, Röder, Sporer, T., and Brix, S. (2007)] disclose algorithms that can be used for placing auditory events around the listener. Wave Field Synthesis systems using a much larger number of loudspeakers than regular surround sound systems are able to position auditory events outside and even inside the room. The sources which are positioned inside the room are usually called "focused sources" because they are calculated to focus sound energy at a specific spot located within the loudspeaker array. Typical WFS systems consist of an array of loudspeakers around the listener. However, the number of loudspeakers needed in theses systems is usually very high leading to the use of expensive loudspeaker panels with small loudspeaker drivers.

Another approach to reproduce focused sources that have similar characteristics as using WFS focused sources is Higher Order Ambisonics (HOA) as for example disclosed in [FOCUSING OF VIRTUAL SOUND SOURCES IN HIGHER ORDER AMBISONICS, Ahrens, Jens, Spors, Sascha, 124th AES Convention, Amsterdam, The Netherlands, May 2008].

In WO 02/071796 A1 a device is described utilizing a plurality of loudspeakers for steering sound to a specific point in space by using individually calculated delays for all loudspeakers. The method for calculating the focused source described in WO 02/071796 A1 is very similar to the way in which WFS focused sources are calculated.

[SOUND FOCUSING IN ROOMS: THE TIME-REVERSAL APPROACH, Sylvain Yon, Mickael Tanter, and Mathias Fink, J. Acoust. Soc. Am., 2002] is an approach for optimizing the effect of a focused source by increasing the difference in sound level between the focus point and its surrounding area.

Some approaches combine a WFS system with regular, but larger and more powerful speakers to be able to combine the high resolution of sound localization that WFS provides with the powerful sound levels that typical live public address (PA) systems can provide.

In EP 1 800 517 A1, a combination of a WFS system with additional large single loudspeakers is described, where the additional loudspeakers are meant to support the WFS system in terms of sound level. The delay between those two systems is set such that the sound of the WFS speakers arrives at the listener position before the sound of the additional loudspeakers. This is done in order to use the precedence effect—the listeners will localize the source according to the sound of the WFS system with the higher localization resolution while the additional loudspeakers will help increase the perceived loudness without significantly affecting the localization perception of the sound source.

It is an object of the present invention to provide an improved apparatus for driving loudspeakers of a sound system and an improved method for driving loudspeakers of the sound system.

The object is achieved by an apparatus according to claim 1 and by a method according to claim 20.

Preferred embodiments of the invention are given in the dependent claims.

According to the invention an apparatus is arranged for driving loudspeakers of a sound system, the sound system comprising at least two loudspeakers of a basic system, and a plurality of loudspeakers of a focus system, wherein each of the loudspeakers of the basic system and of the focus system has a position in an environment, and wherein the apparatus comprises:

- a basic channel provider for providing basic system audio channels for driving the loudspeakers of the basic system,
- a focused source renderer for providing focus system audio channels to drive the loudspeakers of the focus system, wherein the focused source renderer is configured to calculate a plurality of filter values for the loudspeakers of the focus system based on the positions of the loudspeakers of the focus system and based on a position of a focus point, wherein the focused source renderer is configured to generate at least three focus group audio channels for at least some of the loudspeakers of the focus system based on the plurality of filter values and based on a focus audio base signal to provide the focus system audio channels, so that an audio output produced by the loudspeakers of the focus system, when being driven by the focus system audio channels, allows for localizing the position of the focus point by a listener in the environment.

A virtual audio source with a position at a focus point is reproduced by playing back according focus group audio channels. Focus group audio channels are signals which are played back on at least a subset of the focus system audio channels but not necessarily on all focus system audio channels. The number of focus group audio channels is therefore smaller than or equal to the number of focus system audio channels. Since each virtual audio source is represented by a dedicated set of focus group audio channels, the focus group audio channels of a loudspeaker can be added to play back more than one focused audio source with a focus system.

The filter values may be delay values which may be considered FIR filters with delayed dirac pulse. Other filters, e.g. created using the time reversal approach (e.g. as in [SOUND FOCUSING IN ROOMS: THE TIME-REVERSAL APPROACH, Sylvain Yon, Mickael Tanter, and Mathias Fink, J. Acoust. Soc. Am., 2002]), WFS or HOA, may likewise be used in the focus system for focussing the sound to the focus point.

Thus, the focus point can be positioned individually near the head of the listener thereby locally raising the volume of the sound to be played back for the awareness of the listener without having to raise the overall volume.

In an exemplary embodiment the basic system may be a surround system comprising at least four loudspeakers, wherein the basic channel provider is a surround channel provider for providing surround system audio channels.

In an exemplary embodiment the environment is a vehicle, wherein the focus point is positioned near an assumed and/or determined head position of a vehicle occupant, e.g. a driver or passenger in the vicinity of an upper end of a seat arranged in the vehicle.

In an exemplary embodiment the focus system comprises one or more sound bars, each of the sound bars comprising at least three loudspeakers, e.g. arranged in a single enclosure. Likewise the sound bars may comprise a number of loudspeakers in a substantially linear arrangement. The sound bar preferably comprises walls separating the loudspeakers from each other preventing acoustical short-circuiting and crosstalk between the loudspeakers.

The sound bars may be arranged inwardly in the edge of a roof of the vehicle or in a B-pillar of the vehicle.

In an exemplary embodiment at least one directional microphone is directed to a seat so as to acquire speech of a vehicle occupant, wherein the acquired speech is comprised in the focus audio base signal such that the speech acquired from one of the vehicle occupants is played back in at least one focus point near another one of the vehicle occupants.

This improves the intelligibility of speech in in-car conversations between the driver and other passengers thus avoiding loss of content. Distraction for the driver is reduced and concentration increased thereby avoiding security risks even with increased noise levels.

In an exemplary embodiment the focus audio base signal only comprises first frequency portions of an audio effect signal, wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, wherein the focused source renderer is configured to generate the at least three focus group audio channels based on the focus audio base signal such that the focus group audio channels only have frequencies which are higher than a predetermined frequency value, and wherein the basic channel provider is configured to generate the basic system audio channels based on a secondary effect signal, wherein the secondary effect signal only comprises second frequency portions of the audio effect signal, wherein the second frequency portions only have frequencies which are lower than or equal to the second predetermined frequency value, and wherein at least some of the second frequency portions have frequencies which are lower than or equal to the first predetermined frequency value.

Thus, higher frequency portions of audio which are typically present in speech are played back in the focus point while lower frequency portions are played back by the basic system, e.g. the surround system as their exact position in the environment is less important. This allows for using relatively small speakers for the focus system thereby reducing their footprint in the environment and allowing for a greater variety of installation sites within the environment, e.g. the car.

In an exemplary embodiment the second predetermined frequency value is equal to the first predetermined frequency value.

In an exemplary embodiment at least one head tracker unit is arranged for determining a head position of at least one of the vehicle occupants, wherein the apparatus is adapted to shift the focus point depending on the head position. This allows for keeping the sound focussed to the vehicle occupant regardless of their height, seat position and movement within the car. The head tracker may comprise at least one camera.

In an exemplary embodiment the focus system may be a Wave Field Synthesis system or employ Higher Order Ambisonics.

In one embodiment the plurality of the delay values is a plurality of time delay values, and wherein the focused source renderer is adapted to generate each of the focus system audio channels by time shifting the focus audio base signal by one of the time delays of the plurality of time delays.

In another or additional embodiment the plurality of the delay values is a plurality of phase values, and wherein the focused source renderer is adapted to generate each of the focus system audio channels by adding one of the phase values of the plurality of phase values to each phase value of a frequency-domain representation of the focus audio base signal. In the frequency domain the filters may use different delays and/or phase shifts for different frequency ranges. The delay is thus frequency dependent.

In an exemplary embodiment audio signals generated by at least one of a driver assistance system, an entertainment system, a navigation system and a telephone are comprised in the focus audio base signal such that the audio signals are played back in at least one focus point near at least one of the vehicle occupants.

In an exemplary embodiment at least two sound bars are arranged and controlled so as to position a respective focus point near either side of an assumed and/or determined head position of at least one of the vehicle occupants for providing stereo sound. This may be used to play back stereo sound from the entertainment system or for systematically positioning specific audio signals at one ear and other specific audio signals at the other ear of the vehicle occupant. The level of awareness of the driver may thus be raised.

In an exemplary embodiment the audio signal is alternated between the focus points in case of a warning so as to raise the vehicle occupant's awareness for the warning. This may for example be used for warning the driver that an oil or coolant level or pressure is low, that a safe distance to a vehicle travelling ahead is too short, that a tire pressure is low, that the allowed speed is exceeded, etc.

In an exemplary embodiment the directional microphone is adapted to be used for hands-free telephone communication. Thus, an additional hands-free set is not required.

In an exemplary embodiment a plurality of directional microphones are arranged for acquiring speech from a plurality of vehicle occupants, wherein the focus system is controlled to position focus points near the assumed and/or determined head positions of the plurality of vehicle occupants. The apparatus may thus be used for conference calls within the vehicle, wherein the otherwise typical acoustic feedback in conference calls is avoided by directionally acquiring the speech and positioning the focus points outside the range of the directional microphones.

According to the invention a sound system comprises:

a basic system comprising at least two loudspeakers, in particular a surround system with at least four loudspeakers, a focus system comprising a plurality of loudspeakers, a first amplifier module, a second amplifier module, and an apparatus according to the invention, wherein the first amplifier module is arranged to receive the basic system audio channels provided by the basic channel provider of the apparatus according to the invention, and wherein the first amplifier module is configured to drive the loudspeakers of the basic system based on the basic system audio channels, and wherein the second amplifier module is arranged to receive the focus system audio channels provided by the focused source renderer of the apparatus according to the invention, and wherein the second amplifier module is configured to drive the loudspeakers of the focus system based on the focus system audio channels.

According to another aspect of the invention a method for driving loudspeakers of the sound system comprises:

providing basic system audio channels to drive the loudspeakers of the basic system, providing focus system audio channels to drive the loudspeakers of the focus system, calculating a plurality of filter values for the loudspeakers of the focus system based on the positions of the loudspeakers of the focus system and based on a position of a focus point, and generating at least three focus group audio channels for at least some of the loudspeakers of the focus system based on the plurality of filter values and based on a focus audio base signal to provide the focus system audio channels, so that an audio output produced by the loudspeakers of the focus system, when being driven by the focus system audio channels, allows localizing the position of the focus point by a listener in the vehicle.

The filter values may be delay values which may be considered FIR filters with delayed dirac pulse. Other filters, e.g. created using the time reversal approach, WFS or HOA, may likewise be used in the focus system for focussing the sound to the focus point.

The method may be implemented in a computer program, when the computer program is executed by a computer or signal processor, e.g. a digital signal processor.

In an exemplary embodiment the focused source renderer is adapted to generate the at least three focus group audio channels, so that the audio output produced by the focus system allows localizing the position of the focus point by the listener in the vehicle, wherein the position of the focus point is closer to a position of a sweet spot in the vehicle than any other position of one of the loudspeakers of the surround system and closer to the position of the sweet spot than any other position of one of the loudspeakers of the focus system.

In an exemplary embodiment the basic channel provider is configured to generate the basic system audio channels based on the focus audio base signal and based on panning information for blending the focus audio base signal between the basic system and the focus system, and wherein the focused source renderer is configured to generate the at least three focus group audio channels based on the focus audio base signal and based on the panning information for blending the focus audio base signal between the basic system and the focus system.

In an exemplary embodiment panning factors for blending the focus audio base signal between the basic system and the focus system are calculated depending on the panning information and a panning law.

In an exemplary embodiment the focused source renderer is adapted to adjust channel levels of the focus system audio channels to drive the loudspeakers of the focus system.

The basic system may be a 5.1 or 7.1 surround system.

In an exemplary embodiment the focused source renderer is configured to generate the at least three focus group audio channels for at least some of the loudspeakers of the focus system based on the plurality of delay values and based on the focus audio base signal to provide the focus system audio channels, so that sound waves emitted by the loudspeakers of the focus system, when being driven by the focus system audio channels, form a constructive superposition which creates a local maximum of a sum of energies of the sound waves in the focus point.

In an exemplary embodiment the apparatus furthermore comprises a decoder being configured to decode a data stream to obtain a first group of one or more audio input channels, a second group of one or more audio input channels and meta-data comprising information on the position of the focus point, wherein the information on the position of the focus point is relative to a position of a listener, wherein the decoder is arranged to feed the first group of audio input channels into the surround channel provider, and wherein the surround channel provider is configured to provide the surround system audio channels to the loudspeakers based on the first group of audio input channels, and wherein the decoder is arranged to feed the second group of audio input channels and the information on the position of the focus point into the focused source renderer, and wherein the focused source renderer is configured to generate the at least three focus system audio channels based on the focus audio base signal, wherein the focus audio base signal depends on one or more audio input channels of the second group of audio input channels. It is also possible to define two or more focus points, e.g. one near the left ear and another near the right ear of the listener and to play each audio input channel of the second group back at an individual focus point.

In an exemplary embodiment the apparatus furthermore comprises a decoder being configured to decode a data stream to obtain a first group of one or more audio input channels, a second group of one or more audio input channels and meta-data comprising information on the position of the focus point, wherein the information on the position of the focus point is relative to a position of a listener, wherein each of the audio input channels of the first group of audio input channels comprises surround channel information and first focus information, wherein each of the audio input channels of the second group of audio input channels comprises second focus information, wherein the decoder is configured to generate a third group of one or more modified audio channels based on the surround channel information of the first group of audio input channels, wherein the decoder is arranged to feed the third group of modified audio channels into the surround channel provider, and wherein the surround channel provider is configured to provide the surround system audio channels to the loudspeakers based on the third group of modified audio channels, and wherein the decoder is configured to generate a fourth group of modified audio channels based on the first focus information of the first group of audio input channels and based on the second focus information of the second group of audio input channels, wherein the decoder is arranged to feed the fourth group of modified audio channels and the information on the position of the focus point into the focused source renderer, and wherein the focused source renderer is configured to generate the at least three focus system audio channels based on the focus audio base signal, wherein the focus audio base signal depends on one or more modified audio channels of the fourth group of modified audio channels.

In an exemplary embodiment the decoder is configured to decode the data stream to obtain six channels of a 5.1 surround signal as the first group of audio input channels, wherein the decoder is arranged to feed the six channels of the 5.1 surround signal into the surround channel provider, and wherein the surround channel provider is configured to provide the six channels of 5.1 surround signal to drive the loudspeakers of the surround system.

In an exemplary embodiment the decoder is configured to decode the data stream to obtain a plurality of spatial audio object channels of a plurality of encoded spatial audio objects, wherein the decoder is configured to decode at least one object position information for at least one of the spatial audio object channels, wherein the decoder is arranged to feed the plurality of the spatial audio object channels and the at least one object position information into the focused source renderer, wherein the focused source renderer is configured to calculate the plurality of delay values for the loudspeakers of the focus system based on the positions of the loudspeakers of the focus system and based on one of the at least one object position information representing information on the position of the focus point, and wherein the focused source renderer is configured to generate the at least three focus system audio channels for at least some of the loudspeakers of the focus system based on the focus audio base signal, wherein the focus audio base signal depends on one or more of the plurality of the spatial audio object channels.

In an exemplary embodiment the focused source renderer is configured to calculate the plurality of delay values as a first group of delay values, wherein the position of the focus point is a first position of a first focus point, and wherein the focus audio base signal is a first focus audio base signal, wherein the focused source renderer is furthermore configured to generate the at least three focus group audio channels as a first group of focus group audio channels, wherein the focused source renderer is furthermore configured to calculate a second group of delay values for the loudspeakers of the focus system based on the positions of the loudspeakers of the focus system and based on a second position of a second focus point, wherein the focused source renderer is furthermore configured to generate a second group of at least three focus group audio channels for at least some of the loudspeakers of the focus system based on the plurality of delay values of the second group of delay values and based on a second focus audio base signal, wherein the focused source renderer is furthermore configured to generate a third group of at least three focus group audio channels for at least some of the loudspeakers of the focus system, wherein each of the focus group audio channels of the third group of focus group audio channels is a combination of one of the focus group audio channels of the first group of focus group audio channels and one of the focus group audio channels of the second group of focus group audio channels, and wherein the focused source renderer is adapted to provide the focus group audio channels of the third group of focus group audio channels as the focus system audio channels to drive the loudspeakers of the focus system.

In a preferred embodiment of the invention, a loudspeaker array referred to as the sound bar, preferably mounted in a single enclosure, is combined with a basic or surround setup comprising several single loudspeakers. This allows for reproducing regular, e.g. surround audio with additional playback of auditory events placed in the area of the listener's or vehicle occupant's head. The input of such a system comprise of regular 5.1 or 7.1 audio and one or more audio channels along with meta-data about where to position additional auditory events nearby the listener.

The auditory events added to the 5.1/7.1 channels are either rendered exclusively to the focused rendering device, the surround setup or might be reproduced on both audio systems. An auditory event can therefore move between the two systems, e.g. by blending the audio signal from one audio system to the other, depending on whether it is intended to be placed near the listener or placed farer away.

The present invention describes an apparatus and a method for creating additional sound effects to be used in combination with a regular, e.g. surround sound system. This new system can be used to create audio content enhanced by special proximity effects in a vehicle.

The present invention is not required to utilize the precedence effect of the WFS system but rather renders additional auditory events as focused sources in addition to audio reproduced through surround loudspeakers.

The present invention generates one or more focused sources by steering sound energy from several loudspeakers into the room near the listener while playing back the main portion of audio through a conventional surround sound system. Since several loudspeakers with known relative position to each other are needed to create focused sources, these loudspeakers are mounted as an array in a single enclosure ("sound bar"). Since the reproduction of a focused source is only possible if the focus point is configured to be between the listener and the sound bar, multiple sound bars can be used to increase the reproduction area where focused sources can be placed around the listener position. In a preferred embodiment of the invention, two sound bars are placed around the listener in different locations of the vehicle (left, right).

The audio signals of both audio systems, the sound bar and the basic or surround setup, in combination produce an immersive audio scene. The proximate signals are played back through the sound bar while sources farer away or more ambient sounds are reproduced using the conventional setup.

It is even possible to move an auditory event from one sound system to the other. This can be done by introducing panning information for blending the auditory event between the sound bar and the surround setup. An example for that effect would be having a sound starting in one direction in the distance, being rendered with conventional panning techniques through the surround setup, that then gets panned to the sound bar, flying through the vehicle and passing the head of the listener. Finally, the sound could be panned back to the conventional surround setup to appear more distant again.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus, are not limitive of the present invention, and wherein:

Corresponding parts are marked with the same reference symbols in all figures.

FIG. 1 is a schematic view of a sound system 1, comprising:

Figure 1:
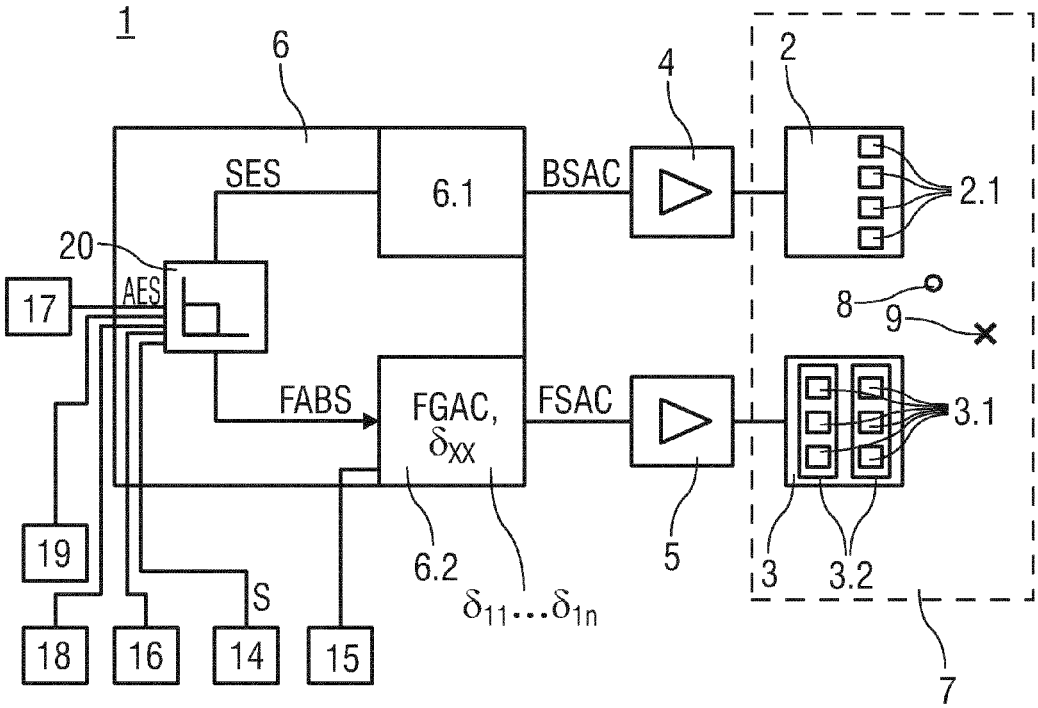
FIG. 1 is a schematic view of a sound system.

- a basic system 2 comprising at least two loudspeakers 2.1,
- a focus system 3 comprising a plurality of at least three loudspeakers 3.1,
- a first amplifier module 4,
- a second amplifier module 5, and
- an apparatus 6 for driving the loudspeakers 2.1, 3.1 of the sound system 1.

In an alternative embodiment, the basic system 2 may comprise only one or two loudspeakers depending on the system design. In particular, a basic system designed as stereo sound system may comprise at least two loudspeakers, wherein a basic system designed as a surround system may comprise three, four, five or more loudspeakers. Further, a simple design of a basic system comprises only one loudspeaker.

Each of the loudspeakers 2.1, 3.1 of the basic system 2 and of the focus system 3 has a position in an environment. The apparatus 6 comprises:

- a basic channel provider 6.1 for providing basic system audio channels BSAC for driving the loudspeakers 2.1 of the basic system 2,
- a focused source renderer 6.2 for providing focus system audio channels FSAC to drive the loudspeakers 3.1 of the focus system 3.

Figure 2:
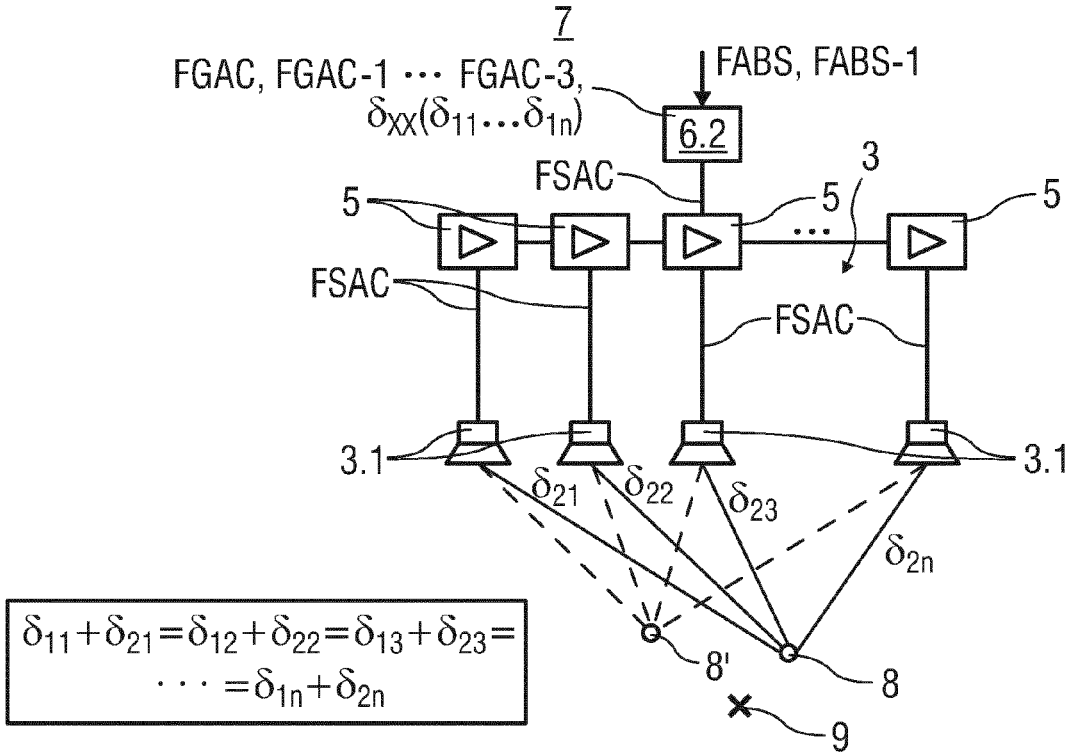
FIG. 2 is a schematic view of a focus system.
Figure 3:
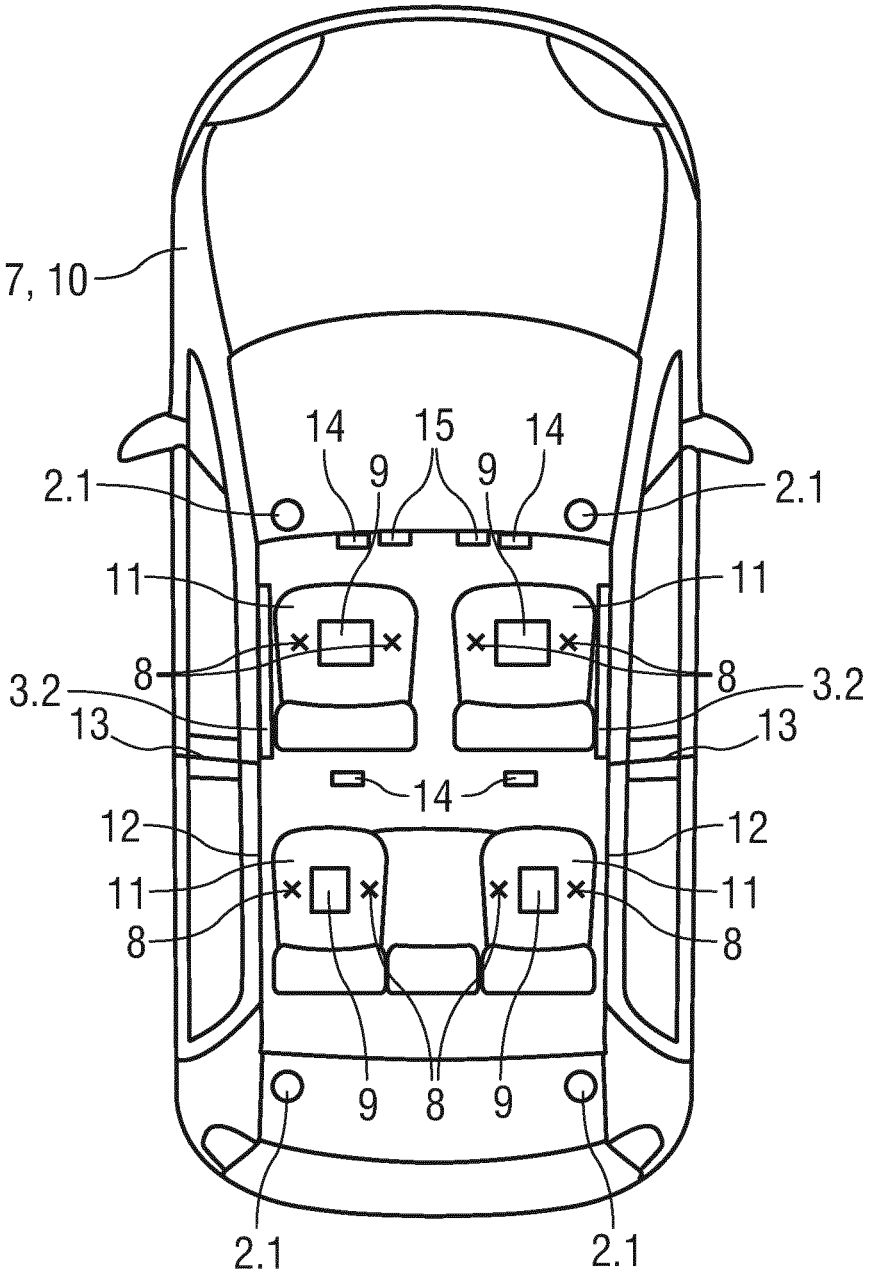
FIG. 3 is a schematic view of a vehicle with the sound system.

The focused source renderer 6.2 is configured to calculate a plurality of filter values, e.g. delay values $\delta_{XX}$, $\delta_{11} \ldots \delta_{1n}$ for the loudspeakers 3.1 of the focus system 3 based on the positions of the loudspeakers 3.1 of the focus system 3 and based on an intended position of a focus point 8 in the environment 7, as illustrated in FIGS. 2 and 3. The focused source renderer 6.2 is configured to generate at least three focus group audio channels FGAC for at least some of the loudspeakers 3.1 of the focus system 3 based on the plurality of delay values $\delta_{XX}$, $\delta_{11} \ldots \delta_{1n}$ and based on a focus audio base signal FABS to provide the focus system audio channels FSAC, so that an audio output produced by the loudspeakers 3.1 of the focus system 3, when being driven by the focus system audio channels FSAC, allows for localizing the position of the focus point 8 by a listener 9 in the environment 7.

In an exemplary embodiment the focused source renderer 6.2 is configured to calculate the plurality of delay values $\delta_{XX}$, $\delta_{11} \ldots \delta_{1n}$ as a first group of delay values as follows:

The position of the focus point 8 is determined as a first position of a first focus point. The focus audio base signal FABS of the basic system 2 is determined as a first focus audio base signal, wherein the focused source renderer 6.2 is configured to generate the at least three focus group audio channels FGAC-1 as a first group of focus group audio channels.

Further, the focused source renderer 6.2 is configured to calculate a second group of delay values for the loudspeakers 3.1 of the focus system 3 based on the positions of the loudspeakers 3.1 of the focus system 3 and based on a second position of a second focus point 8', wherein the focused source renderer 6.2 is furthermore configured to generate a second group of at least three focus group audio channels FGAC-2 for at least some of the loudspeakers 3.1 of the focus system 3 based on the plurality of delay values of the second group of delay values and based on a second focus audio base signal FABS-1.

Furthermore, the focused source renderer 6.2 is configured to generate a third group of at least three focus group audio channels FGAC-3 for at least some of the loudspeakers 3.1 of the focus system 3, wherein each of the focus group audio channels FGAC-3 of the third group of focus group audio channels FGAC-3 is a combination of one focus group audio channel of the first group of focus group audio channels FGAC-1 and one focus group audio channel of the second group of focus group audio channels FGAC-2.

At last, the focused source renderer 6.2 is adapted to provide the focus group audio channels FGAC-3 of the third group of focus group audio channels FGAC-3 as the focus system audio channels FSAC to drive the loudspeakers 3.1 of the focus system 3.

The basic system 2 may be a surround system comprising at least four loudspeakers 2.1, wherein the basic channel provider 6.1 is a surround channel provider for providing basic system audio channels BSAC being surround system audio channels.

In an exemplary embodiment of the invention illustrated in FIG. 3 the environment 7 is a vehicle 10, in particular the interior of the vehicle 10. In this embodiment the focus point 8 is positioned near an assumed and/or determined head position of the listener 9 being a vehicle occupant in the vicinity of an upper end of a seat 11 arranged in the vehicle 10.

In this embodiment the focus system 3 comprises one or more sound bars 3.2, each of the sound bars 3.2 comprising at least three loudspeakers 3.1 in a single enclosure. The sound bars 3.2 are arranged inwardly in the edge 12 of a roof of the vehicle 10. In an alternative embodiment the sound bars 3.2 may be arranged in a B-pillar 13 of the vehicle 10.

Preferably the sound bars 3.2 are arranged laterally from the occupants 9 in the front seats 11. It may be advisable also to arrange sound bars 3.2 laterally from the occupants 9 in the back seats 11.

A directional microphone 14 is directed to each seat 11 so as to acquire speech S of a vehicle occupant 9 sitting in the respective seat 11. The acquired speech S is comprised in the focus audio base signal FABS such that the speech S acquired from one of the vehicle occupants 9 is played back in at least one focus point 8 near another one of the vehicle occupants 9.

The focused source renderer 6.2 may be fed with position data for the focus point 8 or focus points 8' by a control unit (not illustrated), e.g. a board computer of the vehicle 10. The different sound sources 14, 16, 17, 18, 19 may be assigned different focus points 8 and 8'. A head tracker unit 15 may be arranged for determining a head position of the vehicle occupants 9. The head tracker unit 15 may feed the head position directly to the focussed source renderer 6.2 as in FIG. 1, so that the focus points 8 are determined by the focussed source renderer 6.2 depending on the head position. Likewise, the head tracker unit 15 may feed the head position to the control unit, e.g. the board computer (not illustrated) so that the focus points 8 are determined by this control unit and then forwarded to the focussed source renderer 6.2. The apparatus 6 is adapted to shift the focus point 8 depending on the head position acquired by the head tracker 15.

In an exemplary embodiment the focus system 3 may be a Wave Field Synthesis system and/or employ Higher Order Ambisonics.

In one embodiment the plurality of the delay values $\delta_{XX}$, $\delta_{11} \ldots \delta_{1n}$ is a plurality of time delay values, and wherein the focused source renderer 6.2 is adapted to generate each of the focus group audio channels FGAC by time shifting the focus audio base signal FABS by one of the time delays of the plurality of time delays. The focus system audio channels FSAC sent to the focus system 3 are determined by combining, e.g. adding, the signals of the focus group audio channels FGAC, FGAC-1 to FGAC-3 corresponding to the same loudspeaker 3.1.

In an alternative or additional embodiment the plurality of the delay values $\delta_{XX}$, $\delta_{11} \ldots \delta_{1n}$, is a plurality of phase values, and wherein the focused source renderer 6.2 is adapted to generate each of the focus group audio channels FGAC, FGAC-1 to FGAC-3 by adding one of the phase values of the plurality of phase values to each phase value of a frequency-domain representation of the focus audio base signal FABS.

Audio signals generated by at least one of a driver assistance system 16, an entertainment system 17, a navigation system 18, and a telephone 19 are comprised in the focus audio base signal FABS such that the audio signals are played back in at least one focus point 8 near at least one of the vehicle occupants 9.

In the embodiment illustrated in FIG. 3 two sound bars 3.2 of the focus system 3 as one part of the whole sound system 1 are shown. Furthermore, the loudspeakers 2.1 of the basic system 2 are shown as another part of the whole sound system 1. The two sound bars 3.2 are arranged and controlled so as to position a respective focus point 8 near either side of an assumed and/or determined head position of at least one of the vehicle occupants 9 for providing stereo sound. This may be used to play back stereo sound from the entertainment system 17 or for systematically positioning specific audio signals at one ear and other specific audio signals at the other ear of the vehicle occupant 9. The level of awareness of the occupant 9, in particular the driver may thus be raised.

Due to the described combination of the basic system 2 and the focus system 3 according to the invention, in particular according to the embodiments of FIGS. 1 and 2 signal components may be played through both parts of the sound system 1, e.g. through the sound bars 3.2 as well as trough the loudspeakers 2.1. In particular, e.g. signals with lower frequencies may be played through the basic system 2 and signals with higher frequencies may be played through the focus system 3.

Furthermore, the basic channel provider 6.1 is configured to generate the basic system audio channels BSAC based on the secondary effect signal SES and based on panning information for blending the focus audio base signal FABS, FABS-1 between the basic system 2 and the focus system 3, wherein the focus audio base signal FABS, FABS-1 includes a direction signal. On the other hand, the focused source renderer 6.2 is configured to generate the at least three focus group audio channels FGAC, FGAC-1 to FGAC-3 based on the focus audio base signal FABS, FABS-1 and based on the panning information for blending the focus audio base signal FABS, FABS-1 between the basic system 2 and the focus system 3.

For the blending of the focus audio base signal FABS, FABS-1 between the basic system 2 and the focus system 3 panning factors are determined depending on the panning information according to a panning law.

In an exemplary embodiment the audio signal is alternated between the focus points 8, 8' to the left and to the right of the head position in case of a warning so as to raise the occupant's 9 awareness for the warning.

The directional microphone 14 may be adapted to be used for hands-free telephone communication.

The focused source renderer 6.2 may use an algorithm to calculate filter coefficients for generating a plurality of loudspeaker signals which provide a sound field reproducing focused energy at at least one configurable point, e.g. the focus point 8 in the environment 7, e.g. in the vehicle 10. The filter defined by the coefficients is applied to the audio signal of an auditory event to create an output signal for one loudspeaker 3.1 of the sound bar 3.2. A separate filter for each loudspeaker 3.1 is generated and applied to the audio signal of the auditory event. The superposition of the loudspeaker signals will create a sound field in the environment 7, e.g. in the vehicle 10 so that the audio energy in that sound field will be higher at the point where the auditory event should be localized compared to the sound energy in the surrounding area of that spot. If the source is positioned closely to the listener 9, e.g. the occupant, he will get the impression as if the sound source really is positioned at that point.

In a preferred embodiment of the invention, a WFS based algorithm for creating focused sources is used to calculate the filter coefficients. The inputs of the algorithm are:

- the audio signal to be positioned in the vehicle 10 (=focus audio base signal FABS),
- the number of loudspeakers 3.1 in the sound bar 3.2,
- the positions of these loudspeakers 3.1 in the environment 7,
- the position of the focus point 8 in relation to the listener, e.g. the occupant 9, and
- the position of the listener 9 relative to the sound bar 3.2.

The signal to be reproduced at the focus point 8 is delayed by $\delta_{1X}$ ($\delta_{11} \ldots \delta_{1n}$) for each loudspeaker 3.1 so that the total delay ($\delta_{1n}+\delta_{2n}$) including the time $\delta_{2x}$ ($\delta_{21} \ldots \delta_{2n}$) corresponding to the distance from the loudspeaker 3.1 to the focus point 8 is the same for all loudspeakers 3.1. The same calculation is performed for the other focus point 8', wherein the delay $\delta_{2x}$ ($\delta_{21} \ldots \delta_{2n}$) then corresponds to the distance from the loudspeaker 3.1 to the focus point 8'.

By adding the output signals of multiple audio renderers, the focused signals of several auditory events are reproduced using the same sound bar 3.2. This allows for using more than one focused auditory event to be placed near the listener 9 at a time. The game, film or other audio source might render as many events as processing power and bandwidth of the transmission channel to the renderers allows.

Because of the nature of focused sound effects, a high number of loudspeakers 3.1 may be needed to create a strongly audible focus effect that is experienced very clearly by the listener 9. To integrate a sound bar 3.2 for the playback of focused sources into a vehicle scenario, the space needed for the sound bar 3.2 needs to be as small as possible to increase acceptance by possible customers of such an audio solution. Therefore, the loudspeaker drivers or amplifiers 5 need to be as small as possible to optimize the space needed. Since a small loudspeaker driver 5 usually is not able to reproduce low frequency components with sufficient sound pressure level, the sound bar 3.2 may need additional support from the basic system 2, e.g. a surround setup or a stereo system, for lower frequencies. An extension of the invention splits the signal of a focused auditory event into a high frequency and a low frequency component. The cross-over frequency between these components may differ depending on the size and quality of the used loudspeaker drivers 5 in the sound bar 3.2. The low frequency components are played through the basic system 2, e.g. a surround setup or stereo system, while the high frequency components are played as a focus effect through the focus system 3.

The focus audio base signal FABS preferably only comprises first frequency portions of an audio effect signal AES, wherein the first frequency portions only have frequencies which are higher than a first predetermined frequency value, and wherein at least some of the first frequency portions have frequencies which are higher than a second predetermined frequency value. The second predetermined frequency value is higher than or equal to the first predetermined frequency value, wherein the focused source renderer 6.2 is configured to generate the at least three focus group audio channels FGAC based on the focus audio base signal FABS such that the focus group audio channels FGAC only have frequencies which are higher than a predetermined frequency value. The basic channel provider 6.1 is configured to generate the basic system audio channels BSAC based on a secondary effect signal SES, wherein the secondary effect signal SES only comprises second frequency portions of the audio effect signal AES, wherein the second frequency portions only have frequencies which are lower than or equal to the second predetermined frequency value, and wherein at least some of the second frequency portions have frequencies which are lower than or equal to the first predetermined frequency value. The secondary effect signal SES and at least parts of the focus audio base signal FABS may be obtained from the audio effect signal AES by a filter 20.

FIG. 2 illustrates the basic idea of driving the loudspeakers 3.1 to create a focus effect. The basic idea for creating a focus effect is, that each of the delays $\delta_{11} \ldots \delta_{1n}$ of a loudspeaker signal plus the time $\delta_{2x}$ a sound wave, emitted by the loudspeaker 3.1, needs to reach the focus point 8 should be equal for all loudspeakers 3.1. This may be described by the equation:

$$\delta_{11}+\delta_{21}=\delta_{12}+\delta_{22}=\delta_{13}+\delta_{23}=\ldots=\delta_{1n}+\delta_{2n}$$

In this case, it is ensured that the greatest possible constructive superposition of all sound waves of all loudspeakers 3.1 happens in the focus point 8 for all frequency ranges.

LIST OF REFERENCES

1 sound system
2 basic system
2.1 loudspeaker of the basic system
3 focus system
3.1 loudspeaker of the focus system
3.2 sound bar
4 first amplifier module
5 second amplifier module
6 apparatus for driving loudspeakers
6.1 basic channel provider
6.2 focused source renderer
7 environment
8, 8' focus point
9 listener, e.g. vehicle occupant
10 vehicle
11 seat
12 edge of a roof
13 B-pillar
14 directional microphone
15 head tracker unit
16 driver assistance system
17 entertainment system
18 navigation system
19 telephone
20 filter
AES audio effect signal
BSAC basic system audio channels
$\delta_{11} \ldots \delta_{2n}$ delay values
FABS, FABS-1 focus audio base signal
FGAC, FGAC-1 to FGAC-3 focus group audio channels
FSAC focus system audio channels
S speech
SES secondary effect signal

The invention claimed is:

1. An apparatus for driving loudspeakers of a sound system in a vehicle, the sound system comprising at least two loudspeakers of a basic system, and a plurality of loudspeakers of a focus system, wherein each of the loudspeakers of the basic system and of the focus system has a position in an environment, and wherein the apparatus comprises:

a basic channel provider for providing basic system audio channels (BSAC) for driving the loudspeakers of the basic system, a focused source renderer for providing focus system audio channels (FSAC) to drive the loudspeakers of the focus system, wherein the focused source renderer is configured to calculate a plurality of filter values for the loudspeakers of the focus system based on the positions of the loudspeakers of the focus system and based on a position of a focus point, wherein the focused source renderer is configured to generate at least three focus group audio channels (FGAC, FGAC-1 to FGAC-3) for at least some of the loudspeakers of the focus system based on the plurality of filter values and based on a focus audio base signal (FABS, FABS-1) to provide the focus system audio channels (FSAC), so that an audio output produced by the loudspeakers of the focus system, when being driven by the focus system audio channels (FSAC), allows for localizing the position of the focus point by a listener in the environment;

wherein the focus audio base signal (FABS) only comprises first frequency portions of an audio effect signal (AES), wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, wherein the focused source renderer is configured to generate the at least three focus group audio channels (FGAC, FGAC-1 to FGAC-3) based on the focus audio base signal (FABS, FABS-1) such that the focus group audio channels (FGAC, FGAC-1 to FGAC-3) only have frequencies which are higher than a predetermined frequency value, and wherein the basic channel provider is configured to generate the basic system audio channels (BSAC) based on a secondary effect signal (SES), wherein the secondary effect signal (SES) only comprises second frequency portions of the audio effect signal (AES), wherein the second frequency portions only have frequencies which are lower than or equal to the second predetermined frequency value, and wherein at least some of the second frequency portions have frequencies which are lower than or equal to the first predetermined frequency value.

2. The apparatus according to claim 1, wherein the basic system is a surround system comprising at least four loudspeakers, wherein the basic channel provider is a surround channel provider for providing surround system audio channels.

3. The apparatus according to claim 1, wherein the environment is a vehicle, wherein the focus point is positioned near an assumed and/or determined head position of a vehicle occupant in the vicinity of an upper end of a seat arranged in the vehicle.

4. The apparatus according to claim 3, wherein the sound bar is arranged inwardly in the edge of a roof of the vehicle or in a B-pillar of the vehicle.

5. The apparatus according to claim 3, wherein at least one directional microphone is directed to a seat so as to acquire speech of a vehicle occupant, wherein the acquired speech is comprised in the focus audio base signal (FABS) such that the speech acquired from one of the vehicle occupants is played back in at least one focus point near another one of the vehicle occupants.

6. The apparatus according to claim 5, wherein the directional microphone is adapted to be used for hands-free telephone communication.

7. The apparatus according to claim 6, wherein a plurality of directional microphones are arranged for acquiring speech from a plurality of vehicle occupants, wherein the focus system is controlled to position focus points near the assumed and/or determined head positions of the plurality of vehicle occupants.

8. The apparatus according to claim 3, wherein at least one head tracker unit is arranged for determining a head position of at least one of the vehicle occupants, wherein the apparatus is adapted to shift the focus point depending on the head position.

9. The apparatus according to claim 3, wherein audio signals generated by at least one of a driver assistance system, an entertainment system, a navigation system and a telephone are comprised in the focus audio base signal (FABS, FABS-1) such that the audio signals are played back in at least one focus point near at least one of the vehicle occupants.

10. The apparatus according to claim 9, wherein the audio signal is alternated between a plurality of focus points in case of a warning so as to raise the vehicle occupant's awareness.

11. The apparatus according to claim 1, wherein the filter values are delay values ($\delta_{11} \ldots \delta_{1n}$).

12. The apparatus according to claim 1, wherein the focus system comprises one or more sound bars, each of the sound bars comprising at least three loudspeakers.

13. The apparatus according to claim 12, wherein at least two sound bars are arranged and controlled so as to position a respective focus point near either side of an assumed and/or determined head position of at least one of the vehicle occupants for providing stereo sound.

14. The apparatus according to claim 1, wherein the basic channel provider is configured to generate the basic system audio channels (BSAC) based on the focus audio base signal (FABS) and based on panning information for blending the focus audio base signal (FABS, FABS-1) between the basic system and the focus system, and wherein the focused source renderer is configured to generate the at least three focus group audio channels (FGAC, FGAS-1 to FGAS-3) based on the focus audio base signal (FABS, FABS-1) and based on the panning information for blending the focus audio base signal (FABS, FABS-1) between the basic system and the focus system.

15. The apparatus according to claim 1, wherein the focus system is a Wave Field Synthesis system.

16. The apparatus according to claim 1, wherein the focus system employs Higher Order Ambisonics.

17. The apparatus according to claim 1, wherein the plurality of the delay values ($\delta_{11} \ldots \delta_{1n}$) is a plurality of time delay values, and wherein the focused source renderer is adapted to generate each of the focus system audio channels (FSAC) by time shifting the focus audio base signal (FABS, FABS-1) by one of the time delays of the plurality of time delays.

18. The apparatus according to claim 1, wherein the plurality of the delay values ($\delta_{11} \ldots \delta_{1n}$) is a plurality of phase values, and wherein the focused source renderer is adapted to generate each of the focus system audio channels (FSAC) by adding one of the phase values of the plurality of phase values to each phase value of a frequency-domain representation of the focus audio base signal (FABS, FABS-1).

19. A sound system in a vehicle, comprising:

a basic system comprising at least two loudspeakers, a focus system comprising a plurality of loudspeakers, a first amplifier module, a second amplifier module, and an apparatus according to claim 1, wherein the first amplifier module is arranged to receive the basic system audio channels (BSAC) provided by the basic channel provider of the apparatus, and wherein the first amplifier module is configured to drive the loudspeakers of the basic system based on the basic system audio channels (BSAC), and wherein the second amplifier module is arranged to receive the focus system audio channels (FSAC) provided by the focused source renderer of the apparatus, and wherein the second amplifier module is configured to drive the loudspeakers of the focus system based on the focus system audio channels (FSAC).

20. A method for driving loudspeakers of a sound system in a vehicle, the sound system comprising at least two loudspeakers of a basic system, and a plurality of loudspeakers of a focus system, wherein each of the loudspeakers of the basic system and of the focus system has a position in an environment, in particular a vehicle, and wherein the method comprises:

providing basic system audio channels (BSAC) to drive the loudspeakers of the basic system, providing focus system audio channels (FSAC) to drive the loudspeakers of the focus system, calculating a plurality of filter values for the loudspeakers of the focus system based on the positions of the loudspeakers of the focus system and based on a position of a focus point, and generating at least three focus group audio channels (FGAC, FGAC-1 to FGAC-3) for at least some of the loudspeakers of the focus system based on the plurality of filter values and based on a focus audio base signal (FABS, FABS-1) to provide the focus system audio channels (FSAC), so that an audio output produced by the loudspeakers of the focus system, when being driven by the focus system audio channels (FSAC), allows localizing the position of the focus point by a listener in the environment;

wherein the focus audio base signal (FABS) only comprises first frequency portions of an audio effect signal (AES), wherein the first frequency portions only have frequencies which are higher than a first predetermined frequency value, and wherein at least some of the first frequency portions have frequencies which are higher than a second predetermined frequency value, wherein the second predetermined frequency value is higher than or equal to the first predetermined frequency value, wherein the focused source renderer is configured to generate the at least three focus group audio channels (FGAC, FGAC-1 to FGAC-3) based on the focus audio base signal (FABS, FABS-1) such that the focus group audio channels (FGAC, FGAC-1 to FGAC-3) only have frequencies which are higher than a predetermined frequency value, and wherein the basic channel provider is configured to generate the basic system audio channels (BSAC) based on a secondary effect signal (SES), wherein the secondary effect signal (SES) only comprises second frequency portions of the audio effect signal (AES), wherein the second frequency portions only have frequencies which are lower than or equal to the second predetermined frequency value, and wherein at least some of the second frequency portions have frequencies which are lower than or equal to the first predetermined frequency value.

* * * * *